US005935706A

United States Patent [19]

Hoover et al.

[11] Patent Number: 5,935,706

[45] Date of Patent: Aug. 10, 1999

[54] THERMALLY STABLE METAL COATED POLYMERIC MONOFILAMENT OR YARN

[75] Inventors: Merwin F. Hoover, Topsfield; Thomas F. Burke, Wayland, both of Mass.; Thomas H. Stearns, Nashua, N.H.

[73] Assignee: E. I. DuPont De Nemours & Comp, Wilmington, Del.

[21] Appl. No.: 08/656,914

[22] Filed: May 30, 1996

[51] Int. Cl.[6] ..... D02G 3/00

[52] U.S. Cl. ..... 428/375; 428/379; 428/380; 428/381; 428/389

[58] Field of Search ..... 428/366, 379, 428/380, 381, 389, 375

[56] References Cited

U.S. PATENT DOCUMENTS

| | | | |
|---|---|---|---|
| 3,062,666 | 11/1962 | McLeod . | |
| 3,140,188 | 7/1964 | Zirngiebl et al. . | |
| 3,338,762 | 8/1967 | Oja . | |
| 3,531,301 | 9/1970 | Watson . | |
| 3,537,878 | 11/1970 | Bavdtrand et al. . | |
| 3,562,038 | 2/1971 | Shipley et al. . | |
| 3,894,330 | 7/1975 | Bellis | 228/254 |
| 4,092,025 | 5/1978 | Yanagioka | 273/72 R |
| 4,188,032 | 2/1980 | Yanagioka | 273/80 R |
| 4,522,889 | 6/1985 | Ebneth et al. . | |
| 4,634,805 | 1/1987 | Orban . | |
| 4,645,573 | 2/1987 | Orban . | |
| 4,645,574 | 2/1987 | Orban . | |
| 4,764,665 | 8/1988 | Orban et al. . | |
| 4,935,296 | 6/1990 | Stevens | 428/381 |
| 5,213,907 | 5/1993 | Caballero | 428/678 |
| 5,302,415 | 4/1994 | Gabara et al. . | |
| 5,370,934 | 12/1994 | Burch et al. | 428/378 |
| 5,411,795 | 5/1995 | Silverman | 428/389 |
| 5,549,972 | 8/1996 | Hsu et al. | 428/329 |

*Primary Examiner*—Newton Edwards

[57] ABSTRACT

All surfaces of yarn formed of polymeric monofilament fibers are coated with a layer of electroless nickel which can also include an electrolytic metal such as copper on the nickel. The yarn is passed through an electroless Ni aqueous bath under little or no tension so that the electroless Ni can coat all of the monofilament surface substantially uniformly. The nickel coated yarn then can be coated with electrolytic metal such as copper in an electrolytic metal plating step.

14 Claims, 1 Drawing Sheet

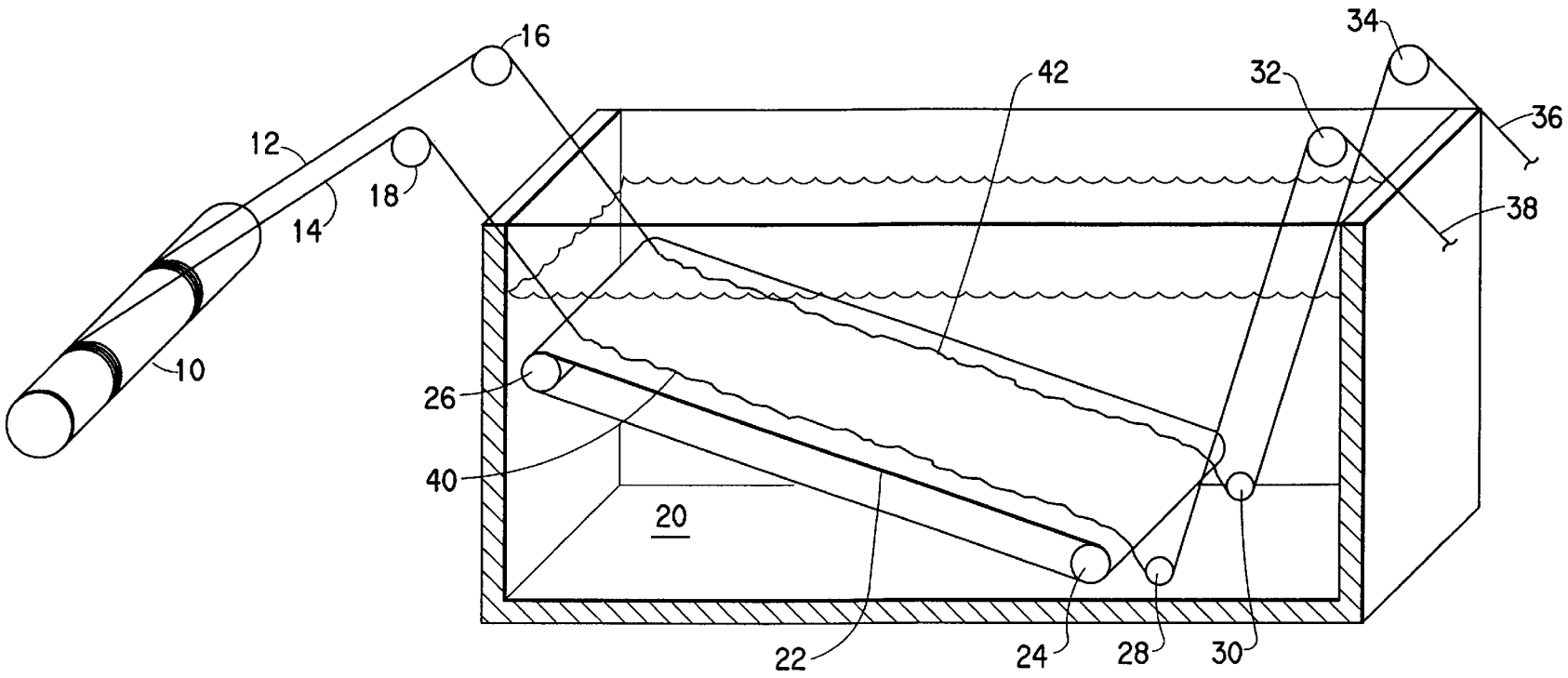
36
38
34
32
30
28
24
42
22
20
16
26
40
18
14
12
10

THERMALLY STABLE METAL COATED POLYMERIC MONOFILAMENT OR YARN

BACKGROUND OF THE INVENTION

This invention relates to a process for completely and substantially uniformly coating the surfaces of a polymeric monofilament or a yarn made from a plurality of polymeric monofilaments with electrolessly deposited nickel and optionally with electrolytically deposited metal on the nickel, and to the thermally stable composite obtained by the process.

At the present time, it is difficult to deposit metal coatings onto polymeric monofilaments or multifilament yarns to form composite products which are thermally stable and/or deposit metal coatings which not easily removed from the monofilament or yarn by low or moderate frictional forces. It has been proposed to coat polymeric fibers with electrolessly deposited copper followed by electrolytically deposited copper. When subjected to thermal cycling tests, however, these coatings are unstable in that they crack and lose metal adhesion.

In order to provide a commercially viable process for metal coating yarns, a continuous process rather than a batch process must be provided. In such a process, yarn to be treated is unwound from a feed storage reel, passed through the appropriate chemical treating steps and then stored on a take up reel. Unfortunately, in presently available yarn processing means, the monofilaments positioned within the interior of the yarn are not coated or are insufficiently coated so that the metal coatings on the monofilaments are non-uniform. A non-uniformly coated yarn has undesirable non-uniform electrical conductivity. In many applications, such as for protective outside layers for coaxial cables, non-uniform metal outside layers are unacceptable.

Polymeric fibers are generally made in the form of bundles of monofilaments called yarns. They are extruded through spineret nozzles having a plurality of holes that control the number of filaments and their diameters. The monofilaments from a given extrusion nozzle are gathered into a single yarn bundle (tow or roving). The diameter of the monofilaments of typical fibers used for weaving into cloth or other useful textile articles are generally in the range of 10–15 micrometers. The size of the yarn bundle is generally designated by the term, denier. Which is the weight, in grams, of 9,000 meters of yarn. Commercial yarns generally range in size from very fine denier up to a very thick string or rope-like consistency of 5,000 denier. Typically, 55–3,000 denier are used for most applications. The number of filaments in a given denier yarn will vary with the density and weight of the polymer forming the filaments but are generally in the same range. For example, with the polyaramid, Kevlar®, a 55 denier yarn contains 24 monofilaments which are 14 micrometers in diameter; a 200 denier yarn contains 89 of these monofilaments; a 400 denier yarn contains 178 of these filaments; and a 3,000 denier yarn contains 1,333 of these monofilaments. There is a generally linear relationship between the number of monofilaments per yarn strand and the denier, as well as the basis weight of the yarn, generally expressed in mg/ft. Yarns formed from a multiplicity of aggregated smaller monofilament polymeric fibers are capable of withstanding tensile forces so that the yarn remains intact under tension. The degree of tensile forces which a given yarn can withstand depends upon the number of monofilaments forming the yarn and upon the type of polymeric composition forming the fibers. For example, polyaramid monofilament, (e.g. Kevlar®) is capable of forming a light weight yarn able to withstand very high tensile forces.

As the content and complexity of electronic equipment installed in military and commercial aircraft has increased over the years, the space/weight devoted to interconnect cabling has likewise increased, along with the need to ensure signal transmission integrity at ever higher frequencies. Interconnect system designers are therefore presented with a challenging, if not contradictory set of requirements: on the one hand, high frequency transmission lines must employ coaxial shielding to ensure signal transmission integrity and to suppress electromagnetic interference (EMI); on the other hand, the shielding in question, typically a braided wire jacket applied in the cable-making process, adds weight and inflexibility to the cables. One obvious approach to this problem is to use smaller diameter wire for the jacketing. Unfortunately, finer gauge copper alloy wire does not have the mechanical strength to reliably withstand the tensions imparted to the wire in the braiding process or in environments such as an aircraft environment where vibration and shock stresses are routine. As a result, designers of coaxial shielding for aircraft interconnect cables are obliged to use wires that are larger and heavier than they need to be if only the electrical requirements of the application are taken into account.

It has been extremely difficult to deposit electroless nickel uniformly and completely onto the surface of monofilaments in a multifiliament yarn bundle by wet chemical electroless processes. Various types of pre-woven fabric are coated with electroless metal, primarily electroless copper, for use as electromagnetic interference (EMI) control and shielding. However, electroless copper, although appearing to have adequate adhesion to the individual monofilament polymer surface of a pre-woven fabric, will not maintain its adhesion after exposure to high temperature or humidity exposure. The copper oxidizes at the polymer-metal interface due to diffusion of entrained moisture in the polymer or oxygen migration which causes a loss in bond integrity. This problem is alleviated by using electroless nickel which forms tight polymeric bonds to the various functional groups on the surface of treated polymers. The resultant nickel-coated filaments are resistant to degradation during exposure to thermal cycling and humidity. Even though pre-woven polyaramid cloth has been previously plated with electroless metals such as copper and nickel, as disclosed in U.S. Pat. No. 4,522,889, complete and substantially uniform metal coatings have not been achieved, particularly at the yarn crossovers of the prewoven fabrics where uncoated filaments commonly occur.

U.S. Pat. No. 5,302,415 describes a process for electrolessely metalizing various polyaramid fibers using copper, nickel, silver, or cobalt. The disclosed process utilizes an 80 to 90% sulfuric acid solution to modify the surfaces of the polyaramid fibers. Modification is achieved by controlled fiber degradation as a consequence of depolymerization, to provide sites for the deposition of a sensitizer which promotes electroless metal deposition. An all-electroless copper construction is undesirable for this application in several respects. The deposition of copper by wet chemistry means deposition directly onto polymer surfaces is undesirable for the reasons set forth above. Its strength of adhesion is extremely weak after thermal cycling accelerates the growth of this copper oxide layer and which eventually leads to interfacial bond failure, i.e., delamination copper from the polymer surface. This phenomenon explains the substantial increase in resistance that all of the electroless copper examples in Table 3 of the referenced patent displayed after exposure to elevated temperature cycling. Resistance changes of this magnitude (4–5 times) are unacceptable for electronic applications, particularly for coaxial shielding. Moreover, the deposition of electroless copper typically produces a coarse-grained metalization which lacks the ductility and flexural endurance that the coaxial cable shielding applications in question require. Furthermore, an all-electroless copper construction would require the addition of another metal layer on each monofilament to protect the exposed copper against long-term oxidation/corrosion. The referenced patent also suggests the alternative use of an all-electroless nickel metalization. No data is supplied in the referenced patent to support the proposed use of an all-electroless nickel process to provide fiber with a metalized surface comparably conductive to copper. However, it is well known that conventional phosphite-reduced electroless nickel processes deposit a layer of metalization having a conductivity typically less than 15% that of copper. Due to oxidation of the phosphorous in the nickel-phosphorous alloy, such deposition form a much more stable surface and are generally preferred for applications involving high corrosion resistance. However, they are highly resistive and difficult to clean (deoxide). Thus, it is difficult to electroplate other metals on these nickel-phosphorous layers, especially as thin coatings on polymeric filaments. Thus, an all-electroless nickel based on conventional phosphite-reduced chemistry is poorly-suited to the goal of achieving a metalized fiber coating with a high conductivity to weight/thickness aspect.

Accordingly it would be desirable to provide polymeric yarn which is completely and substantially uniformly coated with a metal. It would also be desirable to provide such a completely coated yarn capable of having high conductivity to weight/thickness aspect. In addition it would be desirable to provide such a metal coated yarn which can be formed by continuous reel-to-reel process. Such a process would permit the commercial production of completely and substantially uniformly metal coated yarn that could be utilized in a wide variety of environments such as EMI shielding.

BRIEF DESCRIPTION OF THE DRAWING

The FIGURE shows an apparatus suitable for processing yarn in accordance with this invention.

SUMMARY OF THE INVENTION

The present invention provides a composite polymeric monofilament or a composite polymeric yarn formed of a plurality of monofilaments which are completely and substantially uniformly coated with a highly electrically conductive electroless nickel layer. The electroless nickel layer, in turn, can be coated with an electrolytically deposited metal such as copper.

The present invention also provides a process whereby a polymeric monofilament or a polymeric yarn formed of a multiplicity of polymeric monofilaments is completely coated and substantially uniformly coated on all monofilament surfaces with a strongly adherent, highly conductive electroless nickel layer, optionally coated with an electrolytic metal layer.

As a first step, in accordance with the process of this invention, the surfaces of the yarn or the monofilament are contacted with an aqueous composition which renders the surfaces hydrophillic and facilitates absorption of a catalyst for effecting electroless nickel deposition. The surfaces are then contacted with a catalyst sensitizer and a palladium catalyst in order to provide a catalytic surface for the deposition of electroless nickel. As used herein, the term "nickel" as it relates to the initial metal layer, refers to a nickel/boron alloy and excludes nickel/phosphorous alloys. The electroless nickel bath contains both nickel and boron and a reducing agent which produces the nickel-boron alloy coating on the polymeric filaments. Contact of yarn with catalyst sensitizer and catalyst is conducted while the yarn is under little or no tension as described below.

The metalization process is conducted as a reel to reel continuous process in which the yarn is passed through an electroless bath to coat nickel completely and substantially uniformly on all the monofilament surfaces of the yarn. Tension on the yarn passing through the nickel aqueous bath comprising the source of electroless nickel is either eliminated or maintained sufficiently low so that the nickel beaming solution can penetrate into the entire yarn bundle, in particular on the surfaces of the monofilaments located within the yarn bundle interior. It has been found that when the yarn is passed through the electroless nickel bath under even moderate tension, the monofilaments in located at the interior of the yarn bundle are either not coated at all or are incompletely coated so that the metal coating on the yarn is non-uniform. When coating a monofilament, the tension on the monofilament is less than that which causes the monofilament to break.

As an optional additional step, the nickel coated yarn is coated with electrolytic metal such as copper. The electrolytic metal deposition also can be effected in a reel to reel process wherein the nickel-coated yarn positioned within an agitated electrolytic aqueous bath is subjected to little or no tension to permit the aqueous electrolytic bath to penetrate onto the surfaces of the nickel coated monofilaments positioned even within the yarn interior.

When utilizing polyaramid monofilament as the polymeric monofilament or yarn, an optimal composite for electronic shielding and signal-carrying applications where the combination of low electrical resistance and high strength-to-weight is an important design objective is obtained. The coated monofilament or yarn, which can be braided or woven, functions as a substitute for metal wire. The multilayer structure, as well as the process for producing it, embody several improvements over the prior art, among them:

1. The use of an amine-borane reduced electroless nickel as the initial metalization layer to achieve:
   - (a) a metal-polymer bond that in conjunction with a suitably treated polymer surface, does not noticeably degrade under exposure to temperature/humidity cycling or soldering temperatures;
   - (b) a virtually pure nickel substrate is:
     - (1) metallurgically compatible with a subsequent electrolytically applied layer of metal such as copper,
     - (2) inhibits the migration of absorbed moisture or oxygen from the polymer at the interface between the nickel layer and the metal, e.g. copper layer,
     - (3) is sufficiently conductive in thin layers (less than 0.5 micron thick) to enable the metal, e.g. copper to be deposited by high speed electroplating:
   - (c) uniform and complete metalization of each monofilament in the polymeric yarn bundle.

2. A layer of electrolytically-deposited metal, e.g. copper over the amine-borane nickel layer that, by reason of its dense fine-grained composition,
   - (a) has excellent ductility and flexural endurance properties;
   - (b) is more conductive per unit weight than electroless copper.

3. One or more electrolytically-deposited layers of nickel, silver, tin, etc., over the copper layer to provide oxidation/corrosion protection as well as abrasion resistance to the copper.

In one embodiment of a utility of this invention, a construction is provided consisting of a yarn bundle of polyaramid monofilaments metalized with amine-borane reduced electroless nickel only. When chopped into short lengths, such metalized fibers find utility as conductive fillers which and minimizes electrostatic buildup on the surfaces of molded plastic parts used in electrical/electronic applications. In this embodiment the idealized metal coating must be bonded to the polyaramid monofilament surfaces with sufficient adhesion to withstand the mechanical abrasion of the chopping and as well as the elevated temperature experience in the injection molding processes, while as the same time providing an acceptable level of conductivity which also does not materially change due to oxidation, unlike nickel-phosphorous alloys.

Additional utility for the composite yarns or filaments of this invention include connections for sensing apparatus such as diagnostic apparatus, tethers or antenna reflectors.

DESCRIPTION OF THE PREFERRED EMBODIMENTS

The monofilament or multifilament yarn surfaces to be treated in accordance with this invention are formed from a polymeric composition capable of being rendered hydrophilic to a degree such that an aqueous solution of electroless nickel is capable of completely and substantially uniformly coating all the monofilament surfaces with nickel which is sufficiently electrically conductive to permit subsequent electrolytic metal coating on the conductive nickel. Representative suitable polymeric compositions for forming the monofilament or yarn include polyaramid, e.g. Kevlar® or Nomex®, polyamide e.g. Nylon, polyester, polyimide, polyetherimide, acrylics, poytetrafluoroethylene or the like, preferably polyaramid since it provides excellent tensile strength per unit weight. Typically yarns have a denier between about 55 and 3,000 and more typically between about 55 and 600 with 10–15 micron diameter monofilaments. Suitable texturizing or activating compositions which improve the water wetability of the monofilament or yarn monofilaments surfaces and which are commonly available in the art including potassium hydroxide, sodium hydroxide or any caustic composition which can be used alone or with a lower alcohol such methanol or ethanol; chromic acid or the like or other texturizing compositions which do not significantly adversely affect the mechanical properties of the polymeric monofilament surfaces. Other texturizing compositions which can be utilized include acids such as sulfuric acid compositions which are disclosed in U.S. Pat. No. 5,302,415 which is incorporated herein by reference.

Once the clean surfaces have been rendered water wetable, the surfaces are contacted with any one of the catalyst systems to effect electroless metal deposition well known to those versed in the art of electroless plating. Catalyst combinations which can be used in conjunction with the sensitized surfaces are disclosed in U.S. Pat. Nos. 3,011,920 and 3,562,038 which are incorporated herein by reference. The catalyst may be applied in a two step application by first depositing the sensitizer and then the noble metal activator; however, these baths may be combined in a one step operation, e.g., a black colored tin-palladium colloidal dispersion.

The catalyst application is provided for a period, generally of one to about five minutes, and then the sample is immersed in an acidic solution to remove tin from the surface in the process referred to as acceleration. The sample is then passed through in an electroless nickel bath for a period ranging from about two to ten minutes to provide the desired thickness of nickel. Deposition and activation of the catalyst and subsequent deposition of the electroless nickel is conducted under conditions so that the tension on the yarn in the respective chemical treatment baths is zero or is sufficiently low so that the treatment bath contacts all the monofilament surfaces. In a reel to reel process for processing a yarn, one or more feed reels are operated at a faster feed rate than the take up rate of one or more take up reels. The tension on the yarn in the chemical treatment bath or baths positioned between the feed reel(s) and the take up reels is sufficiently low so that the bath contacts all monofilament surfaces of the yarn. The yarn can be passed through the bath unsupported or supported on a moving web which travels at a speed to retain zero or little tension on the yarn. Referring to the FIGURE, a storage roll 10 has wound upon it two multifilament yarns 12 14. Two guide rollers 16 and 18 direct the yarns 14 and 12 from the storage roll 10 and deposit the yarns within bath 20 and onto endless web 22. The endless web 22 is moved about rollers 24–26, at least one of which is powered. The yarns 12 and 14 are passed under guide roller 28 and 30 and are removed from the bath 20 by powered rollers 32 and 34 as treated yarn 36 and 38. The bath can be the pretreatment, catalyst deposition or activation bath or the electroless nickel bath described above. The powered rollers 32 and 34 and the endless web 22 are operated at a speed to assure little or no tension on the yarns 40 and 42 deposited in the bath 20 on endless web 22. Thus, the entire surfaces of each multifilament yarn are contacted with the composition of the bath 20. When processing a monofilament, these speeds are regulated so that tension on the monofilament does not exceed its yield strength.

Suitable electroless nickel baths are those which are boron-based rather than phosphorous based since the boron based baths deposit a form of nickel resistant to oxidation and which are sufficiently conductive to facilitate subsequent electrolytic metal deposition, such as copper onto the nickel surface. Suitable boron based electroless nickel baths are disclosed in U.S. Pat. Nos. 3,062,666; 3,140,188; 3,338,762; 3,531,301; 3,537,878; and 3,562,038 which are incorporated herein by reference. Some typical formulations as follows:

| | | |
|---|---|---|
| 1. | Nickel Sulfate ($NiSO_4.6H_2O$) | 20.00 g/l |
| | Dimethylamine Borane | 3.0 g/l |
| | Citric Acid | 10.0 g/l |
| | Conc. HCl | 25.0 ml/l |
| | Ammonium Hydroxide | to pH 7.0 |
| | 2-mercaptobenzothiazole | 0.5–2.0 mg/l |
| | 65° C. | |
| 2. | Nickel Chloride ($NiCl_26H_2O$) | 16.0 g/l |
| | Dimethylamine Borane | 3.0 g/l |
| | Sodium Citrate | 18.0 g/l |
| | Glycine | 8.0 g/l |
| | Bismuth Nitrate | 20.0 mg/l |
| | Thiorea | 15.0 mg/l |
| | pH 7.0, 65° C. | |

Nickel is deposited on the receptive surfaces by electroless deposition to form an electrically conductive nickel coated surface formed from a nickel-boron alloy rather than a nickel-phosphorous alloy. Typical specific resistivity of a nickel-boron alloy is between about 8 and 15 micro-ohm cm. Typical specific resistivity of a nickel-low phosphorous alloy is 20–50 micro-ohm cm. and for nickel-high phosphorous alloy 150–250 micro-ohm cm. Electrical conductivity of a nickel coated multifilament yarn or monofilament increases with increased filament denier. Nickel ions are reduced in this process onto the catalytic surface of the yarn or monofilament to form a complete and substantially uniform electrically conductive layer. The electroless layer is sufficiently thick to permit the subsequent electrolytic deposition of a uniform metal layer such as copper. Generally, the electroless nickel layer is between about 0.1 micron and 1.0 micron thick but can be thicker if desired.

The use of nickel rather than copper as an initial metal layer provides several significant advantages. Most importantly, in sharp contrast with the characteristics of the copper/polymer interface, the nickel/polymer interface is not degraded as high as about 260° C. Copper is not useful as interfacial metal layer since it can form copper oxide or it can catalyze thermal degradation of the polymer due to the thermal sensitivity of the copper/polymer interface.

The nickel coated monofilament or yarn then can be further coated or plated with electrolytic metal such as electrolytic copper in an electrolytic plating process step. In a preferred electrolytic plating process step, the nickel coated yarn is passed through an electrolytic plating bath in a reel to reel continuous process wherein the bath is agitated such as mechanically or by foaming the bath with a non reactive gas. In this process step, the coated yarn is under little or no tension. This can be accomplished by including one or more powered feed rollers to rotate at a speed equal to or greater than the speed of one or more take-up rollers. By operating in this manner, the yarn positioned between the feed roller(s) and the take-up roller(s) is under little or no tension so that the aqueous electrolytic plating both can penetrate into the entire yarn to contact all nickel coated monofilament surfaces. An electrical charge is applied to the electrolytic plating bath to effect electrolytic metal deposition completely and substantially uniformly on all nickel surfaces. The thickness of the electrolytic metal coating can be controlled by controlling the time, temperature and metal concentration of the bath and by controlling the amount of electrical charge through the bath in a manner well known in this art.

The following examples illustrate the present invention and are not intended to limit the same.

EXAMPLE 1

A spool containing 200 denier(d) Kevlar® containing 89 monofilaments of 14 micrometer diameter which had previously been treated by a process disclosed in U.S. Pat. No. 5,302,415 was conveyed through a continuous treating process on a carrier film wherein the tension was relieved from the yarn strand by pulling on the film as a conveyor. Thus, the yarn simply passed through the process under minimal tension. The process steps included a series of solutions which provided the catalyst system prior to an electroless nickel, electroless nickel deposition, final rinse, drying, and wind-up steps. The 200d Kevlar® yarn first passed through a solution which was about 5% by volume in NaOH which rendered the surface alkaline prior to passing into the palladium activator solution which was an ionic soluble palladium complex sold under the trade name, Neoganth 834 available from Atotech Inc. This solution was made up by using 3% of the Neoganth 834 palladium activator concentrate in 96.5% by volume deionized water with 0.5% of 50% NaOH solution used to adjust the pH to 11.5. The bath was heated to 50° C. for about 2 hours to activate the palladium bath and then cooled to 45° C. for use in treating the yarn. Following the palladium bath, the yarn was passed through two rinse stations, each providing about 1 min. rinse with deionized water, then into a Neoganth WA reducer available from Atotech, Inc. and containing dimethylamineborane reducer solution. The reducer bath was made by taking 0.5% by volume of the Neoganth WA concentrate and diluting it with 99% deionized water containing 0.5% boric acid as a pH buffer. This solution was heated to 35° C. for use in reducing the soluble palladium ion to the palladium metal which provides the active catalytic sites on the polymer surface to initiate the electroless nickel deposition. After exiting the reducer bath, the yarn was conveyed directly into an electroless nickel bath comprising Niklad 752, available from MacDermid Corp. This bath was operated at 70° C. with a pH of 6.6 containing diemethylamine borane as the reducing agent. The bath was made up according to the manufacture's instructions for the percent nickel and reducer. The yarn was conveyed through the bath while supported on a carrier film rather than being unsupported to permit the yarn to pass through the bath under very low tension. Using high agitation in the bath, it was possible to obtain complete penetration of the bath into the yarn bundle and uniform metalization of each monofilament. Typically, a 4 minute dwell time in this bath provided about 30% weight increase to the yarn by the nickel coating. The resultant coated yarn had a resistance of about 100 ohms/ft. Additional yarns processed with shorter dwell times provided proportionately less nickel and higher resistances, while longer dwell times provided proportionately higher metal addition with lower resistance. A cross-sectional analysis provided revealed complete and uniform deposition of nickel around all of the monofilaments in the 200d yarn bundle.

EXAMPLE 2

A hollow picture frame type rack was cut out of 1/16" polyethylene sheeting and U-shaped grooves were milled on the top and bottom of the rack so that Kevlar® yarn could be wound around the rack loosely without tightly aggregating the monofilaments at the turnaround contact junctions on the side of the rack. The racks thus were wound to contain about 20–25 ft. of 200d Kevlar® yarn treated in accordance with the process of U.S. Pat. No. 5,302,415 and containing 89 monofilaments of 14 micrometer diameter which yarn was individually hand dipped in the following process solutions in the following sequence: 2 mins. in a pre-dip at ambient temperatures and pH 11.5 ; direct immersion for about 2 mins. at 45° C. in Activator 834 palladium catalyst available from Atotech Corp. followed by a 1 min. rinse in deionized water; then immersion for 2 mins. in Neoganth WA reducer at 30–35 C. followed by directed immersion into a low phosphorous Niklad 797 electroless nickel bath. This bath was prepared by adding 190 mls. of Niklad 797A (metal concentrate) and 570 mls Niklad 797B (sodium hypophosphite solution), both available from MacDermid Corp. and deionized water to make up 3.8 liters of electroless nickel plating solution. The pH was adjusted to 5.0–5.2 with 50% ammonia and the solution was heated to 90° C. prior to immersion of the rack containing the Kevlar® yarn sample. The racks were agitated while being exposed for a 5 min. immersion time in the electroless nickel bath. This resulted in a 33% weight increase of the yarn the nickel coating. The final dried yarn had a resistance of 300 ohms/ft. which was three times higher than the coated yarn of Example 1.

EXAMPLE 3

The metalized yarn obtained by the process of Example 1 was subsequently electroplated with copper by passing the nickel coated yarn through a gas agitated electrolytic acid copper sulfate plating bath fitted with contact bars which passed electrical current into the filament yarn strand as it entered and exited from the plating bath. The nickel coated 200 d yarn could withstand about 5 amps of current while avoiding yarn damage and added about 65% by weight of copper to produce a material that had a resistance less than 1 ohm/ft. This copper plated yarn still retained all of the good handling, drape, and flexibility characteristics of the original starting yarn. This electrolytic plating provided a fine grained equi-axial crystal structure on the copper.

What is claimed is:

1. A yarn comprising a multiplicity of monofilament polymeric fibers wherein each monofilament is completely and substantially uniformly coated with an electrically conductive electroless nickel-boron alloy coating.

2. The yarn of claim 1 wherein said fibers are solid.

3. The yarn of claim 1 wherein said fibers are hollow.

4. The yarn of any one of claims 1, 2, or 3 wherein said polymeric fibers comprise a polyaramid composition.

5. The yarn of any one of claims 1, 2 or 3 wherein said polymeric fibers comprise a polyamide composition.

6. The yarn of any one of claims 1, 2 or 3 wherein said polymeric fibers comprise a polyester composition.

7. The yarn of any one of claims 1, 2 or 3 wherein said electroless nickel-boron alloy coating is further coated with an electrolytic metal coating.

8. The yarn of claim 7 wherein said electrolytic metal coating is copper.

9. The yarn of claim 4 wherein said electroless nickel-boron alloy coating is further coated with an electrolytic metal coating.

10. The yarn of claim 5 wherein said electroless nickel-boron alloy coating is further coated with an electrolytic metal coating.

11. The yarn of claim 6 wherein said electroless nickel-boron alloy coating is further coated with an electrolytic metal coating.

12. The yarn of claim 9 wherein the electrolytic metal coating is electrolytic copper.

13. The yarn of claim 10 wherein the electrolytic metal coating is electrolytic copper.

14. The yarn of claim 11 wherein the electrolytic metal coating is electrolytic copper.

* * * * *